US005498140A

United States Patent [19]

Kawaguchi et al.

[11] Patent Number: 5,498,140

[45] Date of Patent: Mar. 12, 1996

[54] VARIABLE DISPLACEMENT COMPRESSOR

[75] Inventors: Masahiro Kawaguchi; Masanori Sonobe; Shigeki Kanzaki; Tomohiko Yokono, all of Kariya, Japan

[73] Assignee: Kabushiki Kaisha Toyoda Jidoshokki Seisakusho, Kariya, Japan

[21] Appl. No.: 325,460

[22] PCT Filed: Mar. 16, 1994

[86] PCT No.: PCT/JP94/00416

§ 371 Date: Oct. 28, 1994

§ 102(e) Date: Oct. 28, 1994

[87] PCT Pub. No.: WO95/25225

PCT Pub. Date: Sep. 21, 1995

[51] Int. Cl.[6] ..... F04B 23/08

[52] U.S. Cl. ..... 417/199.1; 417/222.1; 417/272; 417/310; 92/12.2

[58] Field of Search ..... 417/199.1, 222.1, 417/222.2, 269, 272, 310; 92/12.2

[56] References Cited

U.S. PATENT DOCUMENTS

| | | | |
|---|---|---|---|
| 3,256,830 | 6/1966 | Budzich | 417/222.1 |
| 3,257,959 | 6/1966 | Budzich | 417/222.1 |
| 3,904,318 | 9/1975 | Born et al. | 417/199.1 |
| 5,079,996 | 1/1992 | Abousabha et al. | 92/12.2 |

FOREIGN PATENT DOCUMENTS

| | | |
|---|---|---|
| 52-131204 | 11/1977 | Japan . |
| 58-162780 | 9/1983 | Japan . |
| 337378 | 2/1991 | Japan . |
| 3143725 | 6/1991 | Japan . |

OTHER PUBLICATIONS

English translation of a part of the International Search Report in Japanese.

*Primary Examiner*—Charles Freay
*Attorney, Agent, or Firm*—Brooks Haidt Haffner & Delahunty

[57] ABSTRACT

In a housing, a rotor is secured to a drive shaft, and a sleeve is supported movably on the drive shaft. A rotary swash plate is tiltably supported on the sleeve and is coupled to the rotor. Coupled to the rotary swash plate are pistons which move in the respective bores. A refrigerant is supplied to each bore from a suction chamber, and the refrigerant compressed by each piston is discharged from the bores to a discharge chamber. A control valve controls the difference between the pressure in the suction chamber and the pressure in a crank chamber to change the inclination angle of the rotary swash plate, so that the discharge displacement of a compressor becomes variable. In the housing, a spool is slidably provided while enclosing the drive shaft. With the spool advancing into the crank chamber, (when the sleeve engages with the spool,) shifting of the rotary swash plate is restricted to the position that sets the discharge displacement of the discharge chamber to a predetermined restricted displacement. A gear pump which is driven interlocking with the drive shaft is provided in the housing. The discharge pressure of the gear pump is selectively supplied to the spool depending on the level of the discharge pressure of an evaporator. By retracting the spool from the crank chamber based on this pressure supply, the rotary swash plate is permitted to move to the position where the discharge displacement to the discharge chamber becomes zero.

13 Claims, 4 Drawing Sheets

VARIABLE DISPLACEMENT COMPRESSOR

TECHNICAL FIELD

The present invention principally relates to a variable displacement compressor suitable for use in an air conditioning system in a vehicle.

BACKGROUND ART

A variable displacement compressor is used in air conditioning systems installed in vehicles for air-conditioning. Such type of compressor is disclosed in Japanese Unexamined Patent Publication No. 63-16177.

The publication discloses a compressor which is shown in FIG. 5 of the present application and to which attention should be directed. The compressor has a housing 71 in which a crank chamber 72 is formed. A drive shaft 73 is rotatably supported in the crank chamber 72. A rotor 74 is secured on the drive shaft 73, and a rotary swash plate 75 is rotatably and swingably supported on the drive shaft 73. The rotary swash plate 75 is coupled via a hinge mechanism 76 to the rotor 74. The hinge mechanism 76 consists of an elongated hole 74*a* provided in the rotor 74 and a pin 75*a*. The pin 75*a* is attached to the swash plate 75 and is engaged with the elongated hole 74*a*. The swash plate 75 is coupled to the rotor 74 and swingable within the range of the length of this elongated hole 74*a*. An undulation plate 77 is attached to the swash plate 55 with its rotation restricted.

A plurality of bores 78 are formed in the housing 71. A piston 79 is placed in each bore 78. The piston 79 is coupled to the undulation plate 77 and reciprocates within the corresponding bore 78 based on the undulation of the plate 77. A suction chamber 80 is formed adjacent to each bore 78 in the housing 71. A fluid (refrigerant) is supplied to each bore 78 from the suction chamber 80. Likewise, a discharge chamber 81 is formed adjacent to each bore 78 in the housing 71. The fluid compressed by the pistons 79 in the respective bores 78 is discharged into the discharge chamber 81. Formed in the housing 71 is a fluid passage 82 which communicates the crank chamber 72 with the suction chamber 80. Provided in the suction chamber 80 is valve means 83 which senses the pressure in the chamber 80 and adjusts the opening of the bleed fluid passage 82 in response to the pressure.

The thus constituted compressor functions as follows. As the valve means 83 operates in response to the suction pressure in the suction chamber 80, the opening of the bleed passage 82 is adjusted. At this time, the pressure in the crank chamber 72 varies from time to time due to the blow-by gas leaking from each bore 78. This pressure change alters the force acting on the back of the associated piston 79 and the balancing point of the moment that acts on the rotary swash plate 75, thus changing the inclination angle of the swash plate 75 and the undulation plate 77. The stroke of each piston 79 changes due to the angular change, so that the compression displacement of the fluid in each bore 78 is changed, controlling the amount of the fluid led into the bore 78. The suction pressure in the suction chamber 80 is controlled so as to be a predetermined value by the mechanism which varies the compression displacement in this manner.

According to the aforementioned variable displacement type mechanism, as the suction pressure in the suction chamber 80 falls due to a decrease in the thermal load in the air conditioning system, the valve means 83 is operated to reduce the opening of the fluid passage 82. The pressure increase in the crank chamber 72 is accelerated to control the compression displacement of the compressor in the direction of reducing it. When the thermal load further decreases, the valve means 83 is operated to completely close the fluid passage 82, so that the pressure in the crank chamber 72 further rises. This further reduces the compression displacement.

Even in this case, the reduction of the compression displacement is restricted to a predetermined minimum value. This is because that in an extremely small displacement area where the compression displacement becomes zero or extremely small close to zero, no effective compression-oriented work is performed. The restoration of the compression displacement, which should be accomplished by the difference between the suction pressure in the suction chamber 80 and the pressure in the crank chamber 72, becomes thus practically impossible. In recent compressors in which the individual sliding portions in the compressors are required to be lubricated with the oil mist admixed in the refrigerant, the burning at the individual sliding portions and the reduction in durability of the compressors due to insufficiency of refrigerant (lubrication) can be pointed as the factors which restrict the minimum value of the variable compression displacement.

So long as the minimum compression displacement is restricted as mentioned above, when a vehicular air conditioning system including a compressor and evaporator is used in the environment of a cold place or the like, the operation of the compressor must be controlled properly to protect the sliding portions of the compressor against wear and prevent freezing of the evaporator. For example, the compressor should be properly stopped by cutting off the power transmission to the compressor by an electromagnetic clutch. The electromagnetic clutch coupled to the compressor is widely used as an essential component of the current vehicular air conditioning systems.

With the use of a vehicular air conditioning system that employs an electromagnetic clutch, however, the shock at the time the system is activated thereby affects the driving feeling of the vehicle. In addition, the alternator for supplying power to the electromagnetic clutch has a surprisingly low efficiency, increasing the engine load accordingly, which is not negligible, either. In other words, it is easily understood that the elimination of the electromagnetic clutch, if possible, can significantly reduce the weight of the vehicular air conditioning systems as well as can contribute to reducing the fuel consumption.

It is therefore an object of the present invention to ensure protection of the individual sliding portions of a compressor against wear and suppression of over-cooling or the like, while eliminating the electromagnetic clutch.

SUMMARY OF THE PRESENT INVENTION

To achieve the above object, the variable displacement compressor according to the present invention is provided with bores formed in a housing, and a crank chamber formed in the housing. A drive shaft is rotatably supported in the crank chamber. A rotor is secured to the drive shaft. A rotary swash plate is tiltably supported on the drive shaft and moves on the drive shaft in accordance with the change in the inclination angle of the rotary swash plate. The rotary swash plate is coupled to the rotor by a hinge mechanism. Coupled to the rotary swash plate are pistons which reciprocate in the bores as the rotary swash plate undulates while rotating. A suction chamber is provided in the bores for supplying a first fluid thereto. A discharge chamber is provided to discharge the first fluid compressed in the bores based on the movement of the pistons. A control valve is provided to regulate the pressure in the crank chamber. By adjusting the difference between the pressure in the suction chamber and the pressure in the crank chamber by the control valve, the inclination angle of the rotary swash plate can be changed.

A fluid supply source is provided for supplying the first fluid to the suction chamber. A pump, which is driven interlocking with the drive shaft, is provided. A second fluid is pumped out from the pump. A movable piece is movably coupled to the housing. Urging means is provided to urge the movable piece in a moving direction that restricts the movement of the rotary swash plate. Further, pressure supplying means is provided to selectively supply discharge pressure of the pump associated with the second fluid to the movable piece against the urging force of the urging means, in accordance with at least the level of the output pressure of the fluid supply source, in order to retract the movable piece in a direction where the movement of the rotary swash plate is not restricted. The displacement of the first fluid discharged to the discharge chamber from the bores can be minimized (reduced to a predetermined minimum) by restricting the movement of the rotary swash plate by the movable piece, and the displacement of the first fluid discharged to the discharge chamber from the bores can be made zero by releasing restriction of the movement of the rotary swash plate by the movable piece.

DETAILED DESCRIPTION OF THE PRESENTLY PREFERRED EMBODIMENTS

A variable displacement compressor according to one embodiment of the present invention will now be described with reference to FIGS. 1 and 2. In this embodiment, the compressor constitutes one component of a vehicular air conditioning system.

Figure 1:
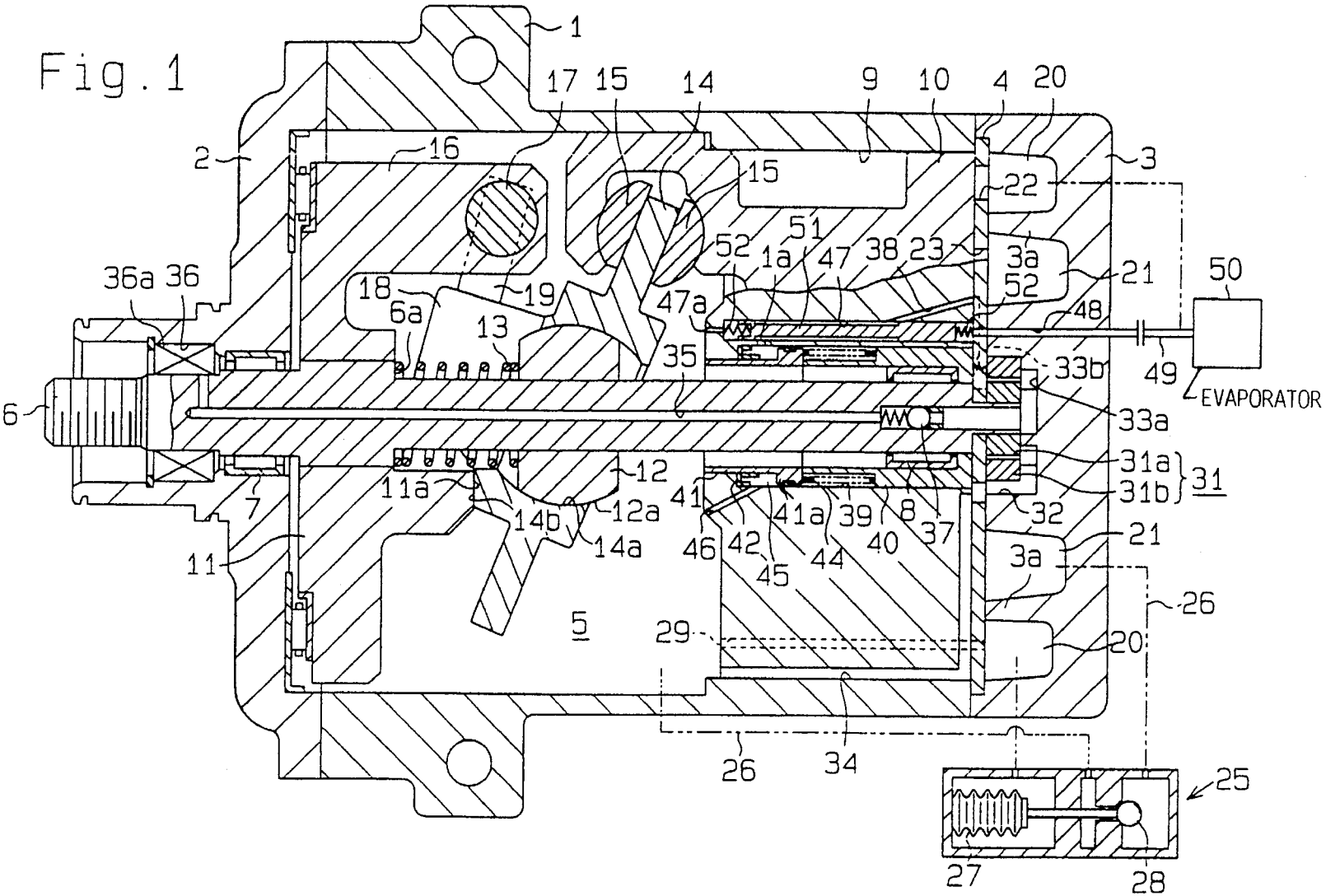
FIG. 1 is a cross-sectional view of a variable displacement compressor according to one embodiment of the present invention.
Figure 2:
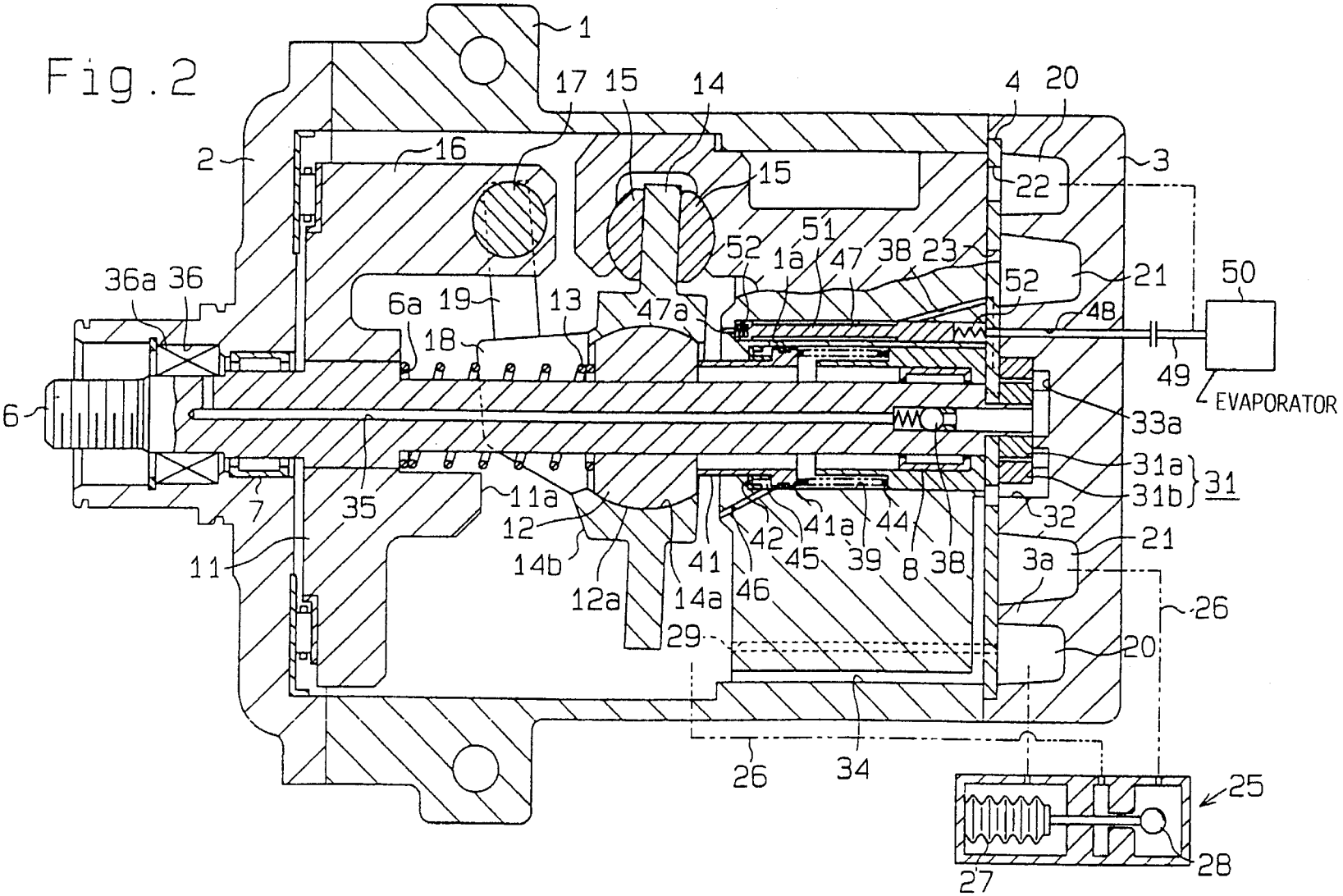
FIG. 2 is a cross-sectional view also showing the variable displacement compressor according to the embodiment of FIG. 1 but in a different operating condition.

As shown in FIGS. 1 and 2, the compressor has a cylinder block 1 with a front housing 2 attached to its front end. A rear housing 3 is attached via a valve plate 4 to the rear end of the cylinder block 1. A drive shaft 6 is accommodated in a crank chamber 5 defined by the cylinder block 1 and the front housing 2. This drive shaft 6 is rotatably supported by bearings 7 and 8. This drive shaft 6 is operably connected with an engine (not illustrated). A plurality of bores 9 are provided in the cylinder block 1, in parallel to the drive shaft 6 to surround this shaft 6. A piston 10 is placed in each bore 9.

A rotor 11, which moves together with the drive shaft 6, is secured on this shaft 6 in the crank chamber 5. A sleeve 12 having a substantially spherical bearing surface **12*a* is also attached rotatably and slidably onto the drive shaft 6. Provided on the drive shaft 6 between a step portion 6*a* of the drive shaft 6 and the sleeve 12 is a spring 13 which urges the sleeve 12 rearward (rightward in FIGS. 1 and 2). A rotary swash plate 14 is supported on the sleeve 12. This rotary swash plate 14 has a concave spherical bearing face 14*a* which is to be fitted on the spherical bearing surface 12*a* of the sleeve 12 to make the rotary swash plate 14 tiltable under engagement of these faces 12*a* and 14*a*. Plural pairs of hemispherical shoes 15 are attached around this rotary swash plate 14. The rotary swash plate 14 is coupled to the pistons 10 via these pairs of shoes 15**.

A restriction face **11*a* is formed on the inner side of the rotor 11, and a to-be-restricted face 14*b* opposing to the restriction face 11*a* is formed at the front side (left-hand side in FIGS. 1 and 2) of the rotary swash plate 14. As shown in FIG. 1, with maximum compression of spring 13, the to-be-restricted face 14*b* is abutted against the restriction face 11*a*, restricting the rotary swash plate 14** to a maximum inclination angle.

Formed on the periphery of the rotor 11 is an arm 16 which extends rearward. This arm 16, which constitutes a hinge mechanism, has a distal end portion to which a support shaft 17 extending perpendicular to the drive shaft 6 is rotatably attached. In association with this support shaft, a coupling portion 18 is formed at the front side of the rotary swash plate 14. Slidably attached to this coupling portion 18 is a guide pin 19, which extends in the radial direction of the cylinder block 1. The distal end of the guide pin 19 is secured to the support shaft 17.

Formed in the rear housing 3 are a suction chamber 20 and a discharge chamber 21, separated by a partition **3*a*. Suction ports 22 and discharge ports 23 open to the respective bores 9 are formed in the valve plate 4. Each suction port 22 and each discharge port 23 is opened or closed respectively by an inlet valve and a discharge valve, unillustrated, in response to the reciprocation of the piston 9. A control valve 25 is provided in the rear housing 3 to control the pressure in the crank chamber 5. In association with this control valve 25, an air supply passage 26 is provided in the cylinder block 1 to communication between the discharge chamber 21 and the crank chamber 5**.

This control valve 25 serves to adjust the opening of the air supply passage 26 in response to the pressure in the suction chamber 20. This valve 25 has a bellows 27 and a valve 28 coupled to the bellows 27. A gas to which a predetermined pressure is applied is sealed in the bellows 27. An unnumbered passage couples the suction chamber 20 to the chamber containing the bellows 27 in valve 25. As the bellows 27 expands or contracts in response to the pressure in the suction chamber 20, the valve 28 operates to control the opening of the air supply passage 26. Further, a fluid passage 29 is provided in the cylinder block 1 to normally provide communication between the crank chamber 5 and the suction chamber 20. The gas in the crank chamber 5 is allowed to escape little by little to the suction chamber 20 via this fluid passage 29. As the pressure in the crank chamber 5 is controlled by the operation of the control valve 25 in accordance with the opening of the supply passage 26, the compression displacement (discharge displacement) of the compressor as a whole becomes variable.

A description will now be given of the mechanism which is a feature of the present invention.

A gear pump 31 consisting of a trochoidal pump, is provided in the rear housing 3. This gear pump 31 serves to pump a lubricating oil, sealed in the crank chamber 5, to the individual portions of the compressor. This pump 31 has an inner rotor 31*a* and an outer rotor 31*b*. The inner rotor 31*a* is coupled directly to the rear end of the drive shaft 6. A suction port 32 of the pump 31 is formed in the rear housing 3. First and second discharge ports 33*a* and 33*b* of the pump 31 are formed in both the rear housing 3 and the valve plate 4. An oil passage 34, which communicates the suction port of the gear pump 31 to the crank chamber 5, is formed through the cylinder block 1 and the valve plate 4. The lubricating oil sealed in the crank chamber 5 is introduced via the oil passage 34 to the suction port 32. In addition, an oil hole 35 extends inside the drive shaft 6 along its axis. The front end side of the oil hole 35 communicates to a seal chamber 36, which is formed in the front housing 2 in association with the periphery of the front end portion of the drive shaft 6. The seal chamber 36 is sealed by a seal member 36*a*.

The oil hole 35 has a larger diameter portion at the rear end, and is communicated to the first discharge port 33*a* of the gear pump 31. A relief valve 37 is provided in this larger-diameter portion. This relief valve 37 only permits the flow of the oil toward the seal chamber 36 from the discharge port 33*a*. Formed in the cylinder block 1 and the valve plate 4 is an oil passage 38 which connects the second discharge port 33*b* with a valve chamber 47 to be described later.

A through hole 39 is formed at the rear portion of the cylinder block 1 along the axis thereof, extending through this block 1. A cylindrical stopper 40 is fitted in this through hole 39 in such a way as to enclose the drive shaft 6. The front end portion of this stopper 40 is smaller in diameter than the remaining portion. The aforementioned bearing 8 is disposed inside the stopper 40 to support the rear end portion of the drive shaft 6.

Meanwhile, a hollow spool 41 is fitted in the through hole 39 in such a way that it is slidable along the drive shaft 6 while enclosing the shaft 6. A flange 41*a* formed at the rear end of the spool 41 is fitted in the through hole 39 via a seal element. The barrel of the spool 41 is fitted in the through hole 39 via a lip seal 42. A coil spring 44 is interposed between the flange 41*a* and the stopper 40. The spool 41 is normally urged forward (leftward in FIGS. 1 and 2) by this spring 44. The axial movement of this spool 41 is restricted by the interference between the stopper 40 and the lip seal 42.

FIG. 2 shows the front end portion of the spool 41 advanced into the crank chamber 5. Under this situation, the front end of the spool 41 can be abutted against the sleeve 12. When the sleeve 12 abuts against the spool 41, the rotary swash plate 14 is caused to have an inclined angle that ensures a compression displacement (discharge displacement) of the compressor of a predetermined minimum restricted displacement. This restricted displacement is about 5 to 10% of the maximum discharge displacement of the compressor, which is the smallest displacement necessary to recover the maximum displacement.

An annular operation chamber 45 is formed between the lip seal 42 and the flange 41a of the spool 41. In addition, an orifice 46 connecting the operation chamber 45 with the crank chamber 5 is formed in the cylinder block 1.

A valve chamber 47 having a bottom and extending parallel to the through hole 39 is formed in the cylinder block 1. This valve chamber 47 communicates with the aforementioned oil passage 38. Formed through the rear housing 3 is a pressure supply passage 48 which extends through the valve plate 4 and housing 3. This pressure supply passage 48 communicates with the valve chamber 47. The pressure supply passage 48 is connected to the outlet of an evaporator 50 via a pipe line 49. The valve chamber 47 has a bottom connected via a small hole 47*a* to the crank chamber 5, and the side thereof connected via a small hole 1*a* to the compression chamber 45.

The evaporator 50 together with this compressor constitutes an air conditioning system. A refrigerant, which is compressed by this compressor and then condensed and liquefied by an unillustrated condenser, is supplied to the evaporator 50. Further, the thus supplied refrigerant is vaporized by the evaporator 50 and then led again into the suction chamber 20 of this compressor. As the refrigerant is vaporized by the evaporator 50, the air around it is cooled. As the refrigerant is thus vaporized by the evaporator 50, a certain level of pressure acts in the valve chamber 47 through its outlet, the pipe line 49 and the pressure supply passage 48.

A spool valve 51 is disposed slidable in the valve chamber 47. The entire length of this spool valve 51 is slightly shorter than that of the valve chamber 47. Both ends of the spool valve 51 are supported at the inner wall of the valve chamber 47 via balance springs 52, respectively.

The pressure in the crank chamber 5 is introduced via the small hole 47*a* to the front end side (left-hand side in FIGS. 1 and 2) of the valve chamber 47. The outlet pressure of the evaporator 50 is introduced to the rear end (right-hand side in FIGS. 1 and 2) of the valve chamber 47. With the outlet pressure of the evaporator 50 approximately balanced with the pressure in the crank chamber 5, the spool valve 51 moves forward in the valve chamber 47 based on the balancing actions of both balance springs 52, as shown in FIG. 2. Under this situation, the spool valve 51 interrupts the communication between the oil passage 38 and compression chamber 45. The hydraulic pressure due to the operation of the gear pump 31 is no longer introduced to the compression chamber 45. Therefore, the spool 41 moves forward under the urging force of the coil spring 44, and the front end portion of this spool 41 protrudes into the crank chamber 5 through the through hole 39.

When the outlet pressure of the evaporator 50 drops, there arises a difference between the outlet pressure of the evaporator and the pressure in the crank chamber 5. Then, the pressures at both ends of the valve chamber 47 are unbalanced, and the spool valve 51 shifts substantially to the middle of the valve chamber 47 as shown in FIG. 1 based on the balancing actions of these balance springs 52. In this state, the spool valve 51 permits communication between the oil passage 38 and the compression chamber 45. The hydraulic pressure based on the operation of the gear pump 31 is immediately introduced to the compression chamber 45. Therefore, the spool 41 is moved rearward by the action of the thus supplied hydraulic pressure and the front end portion of this spool 41 retracts into the through hole 39 from the crank chamber 5. Further, the lubricating oil supplied to the compression chamber 45 is injected via the orifice 46 to the crank chamber 5.

In the thus constituted compressor, when both the compressor and the engine are not in operation, the spool valve 51 moves forward in the valve chamber 47 due to the pressure balance in the compressor to interrupt the communication between the oil passage 38 and the compression chamber 45. The gear pump 31 is not in operation, so that the hydraulic pressure is not supplied to the compression chamber 45. As shown in FIG. 2, the spool 41 is pushed forward by the urging force of the coil spring 44, and its front end portion protrudes into the crank chamber 5. In this state, the spool 41 restricts the movement of the sleeve 12. As a result, the rotary swash plate 14 is held at an inclined angle corresponding to a discharge displacement of a predetermined restricted displacement.

When the drive shaft 6 is rotated in this state upon activation of the engine, compressed refrigerant is discharged to the discharge chamber 21 from each bore 9 by the compressing action of each piston 10 according to the inclined angle of the rotary swash plate 14. At the same time, the gear pump 31 is started with the rotation of the drive shaft 6. When each piston 10 starts the compression action, as described above, the outlet pressure of the evaporator 50, which has been balanced with the pressure in the crank chamber 5, falls relatively, causing a pressure difference at both ends of the valve chamber 47. The spool valve 51 shifts substantially to the middle of the valve chamber 47 for permitting communication between the oil passage 38 and the compression chamber 45. The hydraulic pressure based on the operation of the gear pump 31 is supplied to the compression chamber 45 from the oil passage 38 via the valve chamber 47 and the small hole 1*a*. Then, as shown in FIG. 1, the spool 41 moves rearward against the force of the coil spring 44, and its front end portion retracts into the through hole 39 from the crank chamber 5. That is, at this point of time, the restriction on the movement of the sleeve 12 to set the discharge displacement of the compressor to the predetermined restricted displacement is fully released. The rotary swash plate 14 is supported by the sleeve 12 and is controlled within a freely variable range based on the operation of the control valve 25 in accordance with the cooling load of the air conditioning system.

In other words, when the cooling load further decreases depending on the environmental conditions of the vehicle, requiring no cooling, the spool 41 retracts into the through hole 39. This retraction releases the restriction on the movement of the sleeve 12. Further, this release permits the sleeve 12 and the rotary swash plate 14 to be displaced to the level that makes the discharge displacement of the compressor zero based on the operation of the control valve 25. Consequently, the compression action by each piston 10 is stopped.

When the compressor actually stops functioning in the above manner, the low pressure in the suction chamber 20 is supplied via the fluid passage 29 to the crank chamber 5, reducing the pressure in this chamber 5. Accordingly, the pressure in the compressor is soon balanced, so that the pressure in the crank chamber 5 and the outlet pressure of the evaporator 50 become balanced. Therefore, the spool valve 51 again interrupts the communication between the oil passage 38 and the operation chamber 45. This stops the supply of the hydraulic pressure to the operation chamber 45 through the oil passage 38. At the same time, the lubricating oil in the operation chamber 45 flows into the crank chamber 5 via the orifice 46. Accordingly, the urging force of the coil spring 44 acts again on the spool 41 against the hydraulic pressure acting on the spool 41, causing the front end portion of the spool 41 to advance again into the crank chamber 5. As the sleeve 12 is engaged by the spool 41, the displacement of the rotary swash plate 14 is forcibly returned to the state to set the discharge displacement of the compressor to the restricted minimum displacement.

When the rotary swash plate 14 is held at an inclined angle in the above manner for allowing each piston 10 to resume compression action, the spool 41 immediately retracts into the through hole 39 through the inverting action of the spool 51 and the resumption of the supply of the hydraulic pressure to the operation chamber 45. So long as the no-cooling requiring condition continues, the discharge displacement of the compressor is kept zero or to a very small level close to zero. As a result, overcooling and power consumption based on the operation of the compressor are suppressed. At the same time, the lubricating oil is supplied to the individual portions based on the minimum compression action of each piston 10, thus protecting the individual sliding portions of the compressor against wear.

If the discharge hydraulic pressure of the gear pump 31 is excessively increased, the relief valve 37 is activated to allow part of that pressure to escape into the seal chamber 36 via the oil hole 35. Therefore, the lubricating oil is also supplied to the seal chamber 36 to effectively lubricate the seal member 36*a*.

Figure 4:
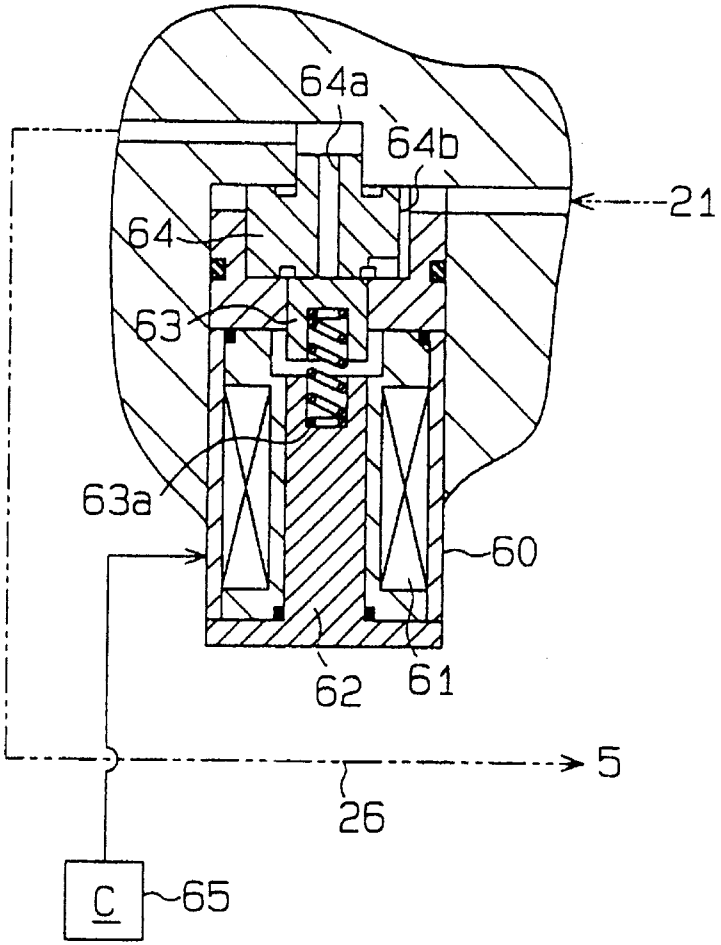
FIG. 4 is also a cross-sectional view of the control valve of FIG. 3 showing a different operating condition.
Figure 3:
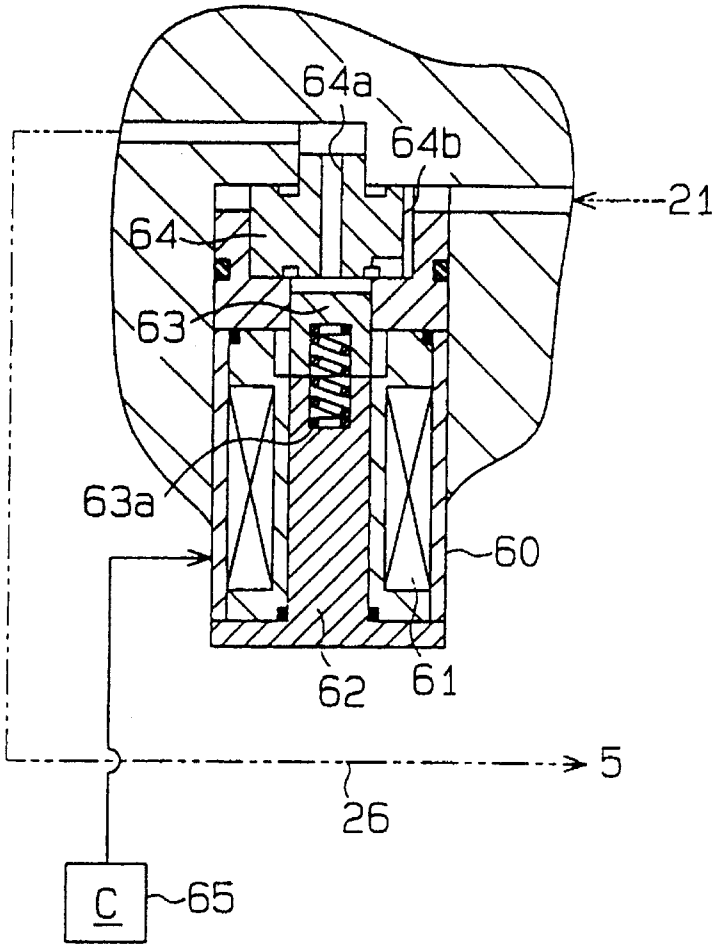
FIG. 3 is a cross-sectional view of a control valve according to another embodiment of this invention.

The present invention is not limited to this embodiment, for example, an electromagnetic valve 60 as shown in FIGS. 3 and 4 may be used as the control valve. This electromagnetic valve 60 has a solenoid 61 supported on a fixed iron core 62. The fixed iron core 62 is provided with a movable iron core 63 which can approach the fixed iron core 62 via a spring 63*a*. A valve 64 is disposed near the upper end of the movable iron core 63. The valve 64 has at the center a through hole 64*a* extending in the axial direction, and a cutaway groove 64*b* on the circumference, extending in the axial direction. The crank chamber 5 side of the air supply passage 26 is connected to the through hole 64*a*, and the discharge chamber 21 side of the air supply passage 26 is connected to the cutaway groove 64*b*. As the movable iron core 63 is attracted to the fixed iron core 62 when the solenoid 61 of the electromagnetic valve 60 is energized, the discharge chamber 21 is allowed to communicate with the air supply passage 26 via the cutaway groove 64*b* and the through hole 64*a*, opening this passage 26. As the movable iron core 63 is spaced from the fixed iron core 62 when the solenoid 61 is de-energized, the communication between the through hole 64*a* and the air supply passage 26 is interrupted, closing the air supply passage 26. By opening or closing the supply passage 26 in this manner, the pressure in the crank chamber 5 is controlled so that the discharge displacement of the compressor becomes variable.

This electromagnetic valve 60 intermittently opens the air supply passage 26 based on an instructed value from a computer 65 in accordance with the suction pressure or discharge pressure to finely control the pressure in the crank chamber 5, thus allowing the discharge displacement of the compressor to be continuously variable.

When the suction pressure of the compressor is higher than a predetermined value, the air supply passage 26 is opened by the electromagnetic valve 60 to set the discharge displacement of the compressor to 100%. When the suction pressure of the compressor is lower than the predetermined value, the air supply passage 26 is closed to set the discharge displacement of the compressor to 0% or a value close to 0%. It is also possible to perform control in such a manner that the discharge displacement may not assume an intermediate value between 100% and 0%. This allows the control of the electromagnetic valve 60 to be simpler.

Figure 5:
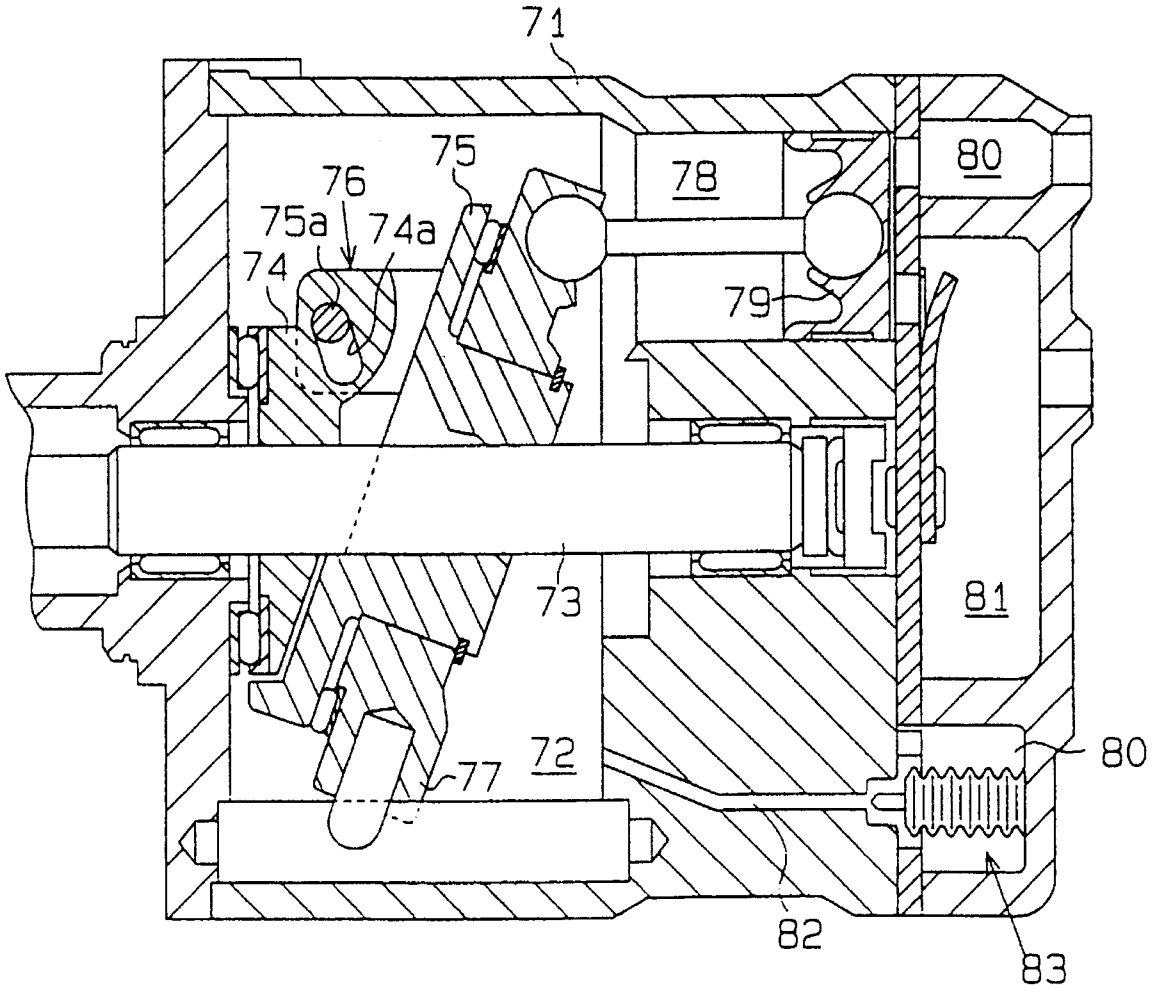
Fig. 5 PRIOR ART
FIG. 5 is a cross-sectional view showing the variable displacement compressor according to the prior art.

Further, the aforementioned electromagnetic valve 60 may be provided as the control valve in the fluid passage 82 that communicates the crank chamber 72 with the suction chamber 80 as in the prior art shown in FIG. 5.

Furthermore, although the rotary swash plate 14 is urged by the spring 13 via the sleeve 12 in the above-described embodiment, the sleeve may be omitted and the rotary swash plate may be urged directly by urging means, such as a spring.

INDUSTRIAL APPLICABILITY

The variable displacement compressor according to this invention can eliminate the use of an electromagnetic clutch, which controls the input from the power source, for controlling the driving of the compressor. This invention can also contribute to reducing the weight of the compressor and reducing the load of the power source. Further, it is possible to prevent overcooling or freezing of the evaporator due to overcooling in the air conditioning system, which has this compressor as one component, as well as, burning or the like in the compressor due to insufficient refrigerant (lubricating oil).

We claim:

1. A variable displacement compressor comprising a swash plate tiltably supported on a rotary drive shaft in a crank chamber in a housing, said swash plate being arranged to move in the axial direction of said drive shaft to tilt within a range defined between a maximum inclined position and an upright position, said swash plate being coupled to a piston which is capable of reciprocating in a cylinder bore in accordance with an undulating movement of said swash plate, whereby gas supplied to said cylinder bore from an evaporator through a suction chamber is compressed by said piston and discharged to a discharge chamber, and the volume of the gas discharged to said discharge chamber is determined by the inclined position of the swash plate which inclined position is a function of a cooling load on the compressor, said tilting range of said swash plate including a predetermined minimum inclined position adjacent to the upright position where the volume of discharged gas to said discharge chamber from said cylinder bore is a predetermined minimum above zero;

a rotor secured to said drive shaft;

hinge means for connecting said swash plate with said rotor;

means for controlling the pressure in said crank chamber whereby the inclined position of said swash plate is altered in accordance with the difference between the pressures in said suction chamber and said crank chamber;

means for preventing said swash plate from tilting beyond said predetermined minimum inclined position to said upright position when said cooling load is minimum, said preventing means being constructed and arranged to bear against said swash plate for limiting the tilting movement of the swash plate when the pressures in said evaporator and said crank chamber are balanced with respect to each other; and means for applying hydraulic pressure to said preventing means for withdrawing said preventing means from bearing against said swash plate whereby said swash plate is enabled to tilt between said maximum inclined position and said upright position.

2. The compressor as set forth in claim 1, wherein said means for preventing said swash plate from tilting beyond said predetermined minimum includes:

a spool movably coupled to said housing; and a spring for biasing said spool toward abutting against said swash plate.

3. The compressor as set forth in claim 2, wherein said spool has a hollow cylindrical shape and surrounds said drive shaft while being moveable along said drive shaft.

4. The compressor as set forth in claim 2, wherein said means for applying hydraulic pressure includes:

an operation chamber disposed adjacent said spool for urging said spool against said spool biasing spring as a function of fluid pressure in said operation chamber;

an hydraulic pump actuated in synchronism with rotation of said drive shaft; and an hydraulic passage connecting said operation chamber with said hydraulic pump for supplying hydraulic fluid under pressure from said hydraulic pump to said operation chamber.

5. The compressor as set forth in claim 1, wherein said means for controlling the pressure in said crank chamber includes a control valve for adjusting said pressure in said crank chamber in accordance with a pressure selected from the group consisting of the pressures in said discharge chamber and said suction chamber, wherein the displacement of the compressor is successively varied.

6. The compressor as set forth in claim 5, wherein said swash plate tilts between said maximum inclined position and the upright position or the predetermined minimum inclined position in accordance with the pressure in said crank chamber.

7. The compressor as set forth in claim 6, wherein said means for controlling the pressure in said crank chamber includes an electromagnetic valve which is selectively energized and deenergized for adjusting the pressure in said crank chamber.

8. The compressor as set forth in claim 4, wherein said hydraulic pump consists of a trochoid pump having an inner rotor and an outer rotor, said trochoid pump supplying lubricant inside the compressor.

9. A variable displacement compressor comprising a swash plate tiltably supported on a rotary drive shaft in a crank chamber in a housing, said swash plate being arranged to move in the axial direction of said drive shaft to tilt within a range defined between a maximum inclined position and an upright position, said swash plate being coupled to a piston which is capable of reciprocating in a cylinder bore formed in the housing in accordance with an undulating movement of the swash plate, whereby gas supplied to the cylinder bore from an evaporator through a suction chamber is compressed by the piston and discharged to a discharge chamber, and the volume of the gas discharged to said discharge chamber is determined by the inclined position of the swash plate which inclined position is a function of a cooling load on the compressor, said tilting range of said swash plate including a predetermined minimum inclined position adjacent to the upright position where the volume of discharged gas to said discharge chamber from said cylinder bore is a predetermined minimum above zero;

a rotor secured to said drive shaft;

hinge means for connecting said swash plate with said rotor;

a control valve for adjusting the pressure in said crank chamber in accordance with a pressure selected from the group consisting of the pressures in said discharge chamber and said suction chamber, whereby the inclined position of the swash plate is altered in accordance with the difference between the pressures in said suction chamber and said crank chamber;

a spool movably coupled to said housing;

a spring for biasing said spool against said swash plate for preventing said swash plate from tilting beyond said predetermined minimum inclined position to said upright position when the pressures in said evaporator and said crank chamber are balanced with respect to each other;

an operation chamber operatively coupled to said spool for urging said spool in the direction against the force of said spring when the pressure in said operation chamber increases;

an hydraulic pump actuated in synchronism with rotation of said drive shaft; and an hydraulic passage connecting said operation chamber with said hydraulic pump for supplying hydraulic fluid under pressure from said hydraulic pump to said operation chamber, whereby said spool is withdrawn from against said swash plate to enable said swash plate to tilt between said maximum inclined position and said upright position.

10. The compressor as set forth in claim 9, wherein said spool has a hollow cylindrical shape and surrounds said drive shaft while being moveable along said drive shaft.

11. The compressor as set forth in claim 10, wherein said control valve for adjusting the pressure in said crank chamber includes an electromagnetic valve which is selectively energized and deenergized for adjusting the pressure in said crank chamber.

12. The compressor as set forth in claim 4, wherein said hydraulic pump consists of a trochoid pump having an inner rotor and an outer rotor, said trochoid pump supplying lubricant inside the compressor.

13. A variable displacement compressor comprising a swash plate tiltably supported on a rotary drive shaft in a crank chamber in a housing, said swash plate being arranged to move in the axial direction of said drive shaft to tilt within a range defined between a maximum inclined position and an upright position, said swash plate being coupled to a piston which is capable of reciprocating in a cylinder bore formed in the housing in accordance with an undulating movement of the swash plate, whereby gas supplied to the cylinder bore from an evaporator through a suction chamber is compressed by the piston and discharged to a discharge chamber, and the volume of the gas discharged to said discharge chamber is determined by the inclined position of the swash plate which inclined position is a function of a cooling load on the compressor, said tilting range of said swash plate including a predetermined minimum inclined position adjacent to the upright position where the volume of discharged gas to said discharge chamber from said cylinder bore is a predetermined minimum above zero;

a rotor secured to said drive shaft;

hinge means for connecting said swash plate with said rotor;

a control valve for adjusting the pressure in said crank chamber in accordance with a pressure selected from the group consisting of the pressures in said discharge chamber and said suction chamber, whereby the inclined position of the swash plate is altered in accordance with the difference between the pressures in said suction chamber and said crank chamber;

a spool movably coupled to said housing;

a spring for biasing said spool against said swash plate for preventing said swash plate from tilting beyond said predetermined minimum inclined position to said upright position when the pressures in said evaporator and said crank chamber are balanced with respect to each other;

an operation chamber operatively coupled to said spool for urging said spool in the direction against the force of said spring when the pressure in said operation chamber increases;

an hydraulic trochoid pump actuated in synchronism with rotation of said drive shaft, said trochoid pump having an inner rotor and an outer rotor and constructed for supplying lubricant inside the compressor; and an hydraulic passage connecting said operation chamber with said hydraulic pump for supplying hydraulic fluid under pressure from said hydraulic pump to said operation chamber whereby said spool is withdrawn from against said swash plate to enable said swash plate to tilt between said maximum inclined position and said upright position.

* * * * *